US005105979A

United States Patent [19]

Bakx et al.

[11] Patent Number: 5,105,979

[45] Date of Patent: Apr. 21, 1992

[54] VENDING MACHINE

[75] Inventors: Adrianus A. M. Bakx, Oosterhout; Johannes J. van Dalen, Groot-Ammers; Cornelis J. B. Peeters, Etten-Leur; Antonius P. M. Pelkmans, Gilze, all of Netherlands

[73] Assignee: Fri-Jado B.V., Etten-Leur, Netherlands

[21] Appl. No.: 578,733

[22] Filed: Sep. 6, 1990

[30] Foreign Application Priority Data

Sep. 7, 1989 [NL] Netherlands ..... 8902246
Sep. 21, 1989 [NL] Netherlands ..... 8902370

[51] Int. Cl.[5] ..... A24F 27/14
[52] U.S. Cl. ..... 221/150 HC; 99/357
[58] Field of Search ..... 222/150 A, 150 HC, 150 R; 219/10.55 R; 99/357, 327

[56] References Cited

U.S. PATENT DOCUMENTS 3,653,541 4/1972 Crum ..... 221/150 HC
3,838,790 10/1974 Naruse ..... 221/150
4,482,078 11/1984 Reiss ..... 221/150 A

FOREIGN PATENT DOCUMENTS 956604 10/1974 Canada .
0184655 10/1985 European Pat. Off. .
3502717 7/1986 Fed. Rep. of Germany .
2597239 4/1986 France .
2622998 10/1987 France .
8504743 10/1985 PCT Int'l Appl. .
2134503 8/1984 United Kingdom .
2209330 10/1989 United Kingdom .
2209332 10/1989 United Kingdom .

*Primary Examiner*—Robert P. Olszewski
*Assistant Examiner*—Kenneth Noland
*Attorney, Agent, or Firm*—Webb, Burden, Ziesenheim & Webb

[57] ABSTRACT

A vending machine for food goods is provided with refrigerated storage holders. By means of a selection device package refrigerated products are removed from a storage holder and transferred to a microwave oven. According to the invention a number of microwave ovens is provided in order to enlarge the capacity of the vending machine. Means are provided to position the food products in one of the microwave ovens available.

14 Claims, 2 Drawing Sheets

VENDING MACHINE

Figure 1:
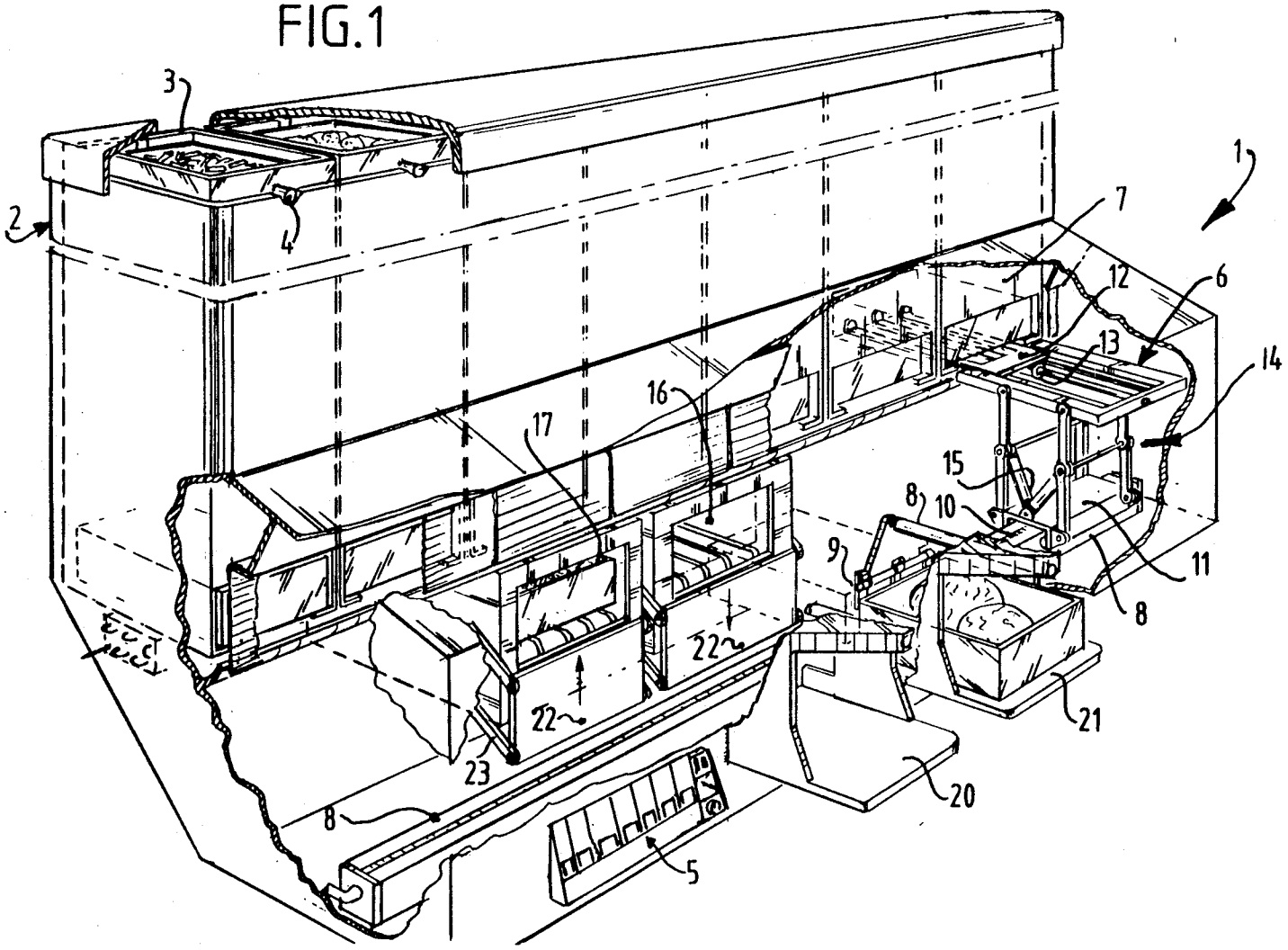

The invention relates to a vending machine for food goods provided with cooled storage holders for packaged food goods, a selection device for selecting chosen storage holders, first means for removing from a storage holder and transferring to a microwave oven of a packaged product and second means for displacing the packaged product from the microwave oven to a take-out device.

Such a vending machine is known from GB-A-2209330.

The invention has for its object to provide means for enlarging the capacity of such a vending machine.

This is achieved according to the invention in that a number of microwave ovens is present and the first means comprise conveying means for displacing a product from a place close to a chosen storage holder to a position close to a chosen microwave oven.

As a result of the invention it becomes possible to select the position of the storage holder independently of the position of the microwave oven. It hereby becomes possible to select a number of microwave ovens and a larger number of storage holders. One conveying means can nevertheless suffice, since the time necessary for selecting the storage holder, the removal of the product therefrom and the transport to the microwave oven is relatively short compared to the required heating-up time.

In preference the conveying means are formed by a carriage movable along a horizontal guide and provided with a plate movable between a top position at the height of the underside of a storage holder and a bottom position at the height of the access opening of the microwave oven.

The storage holders are preferably formed by a vertically disposed frame and a roughly cylindrical holder loosely placeable in the frame. In this manner holders filled with products can be placed directly from the cold store into such a frame.

Further features and advantages of the invention will become apparent from the following description of an embodiment.

Figure 2:
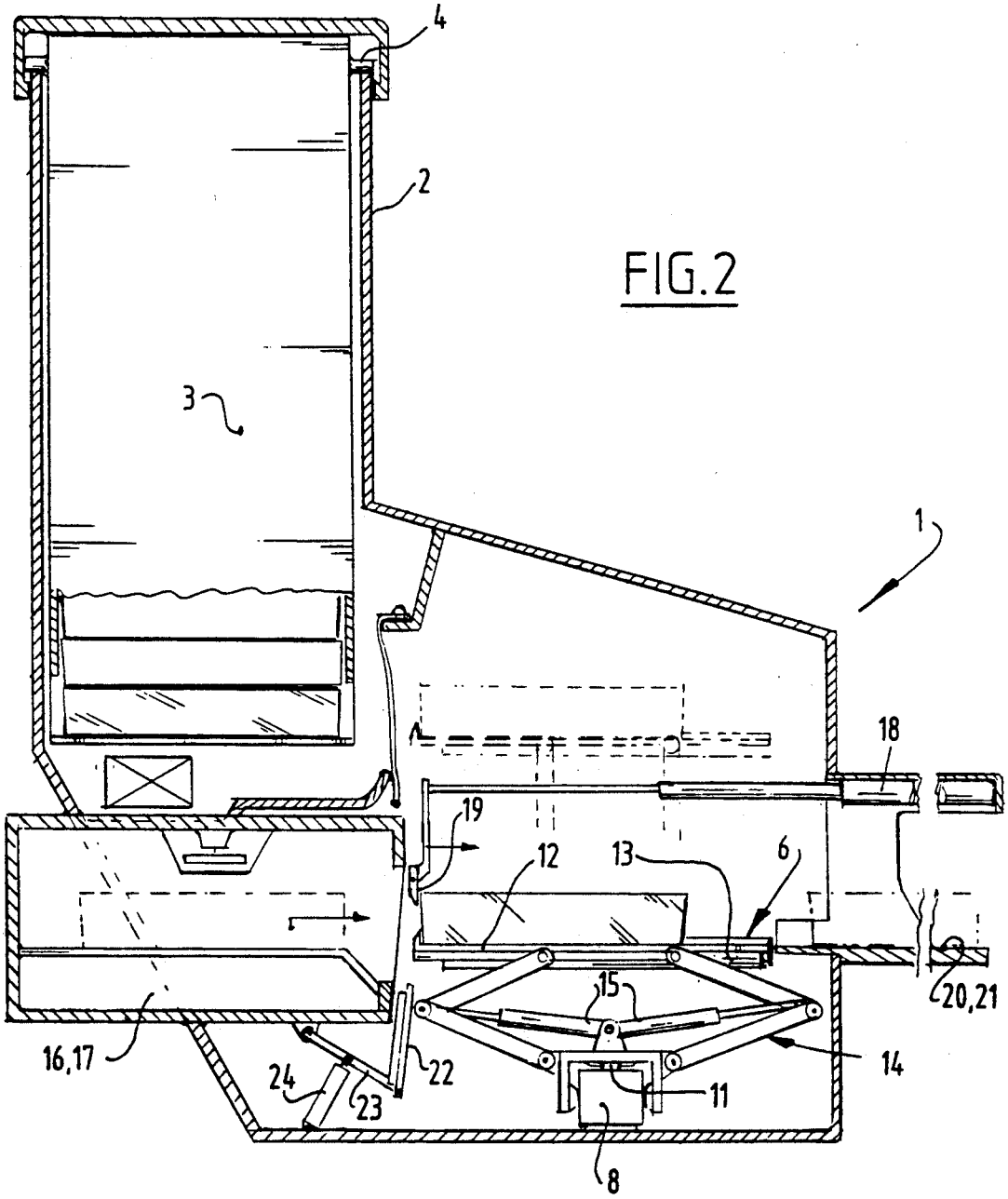

In the drawings:

FIG. 1 shows a perspective view of a vending machine according to the invention, and FIG. 2 is a cross-sectional view of the vending machine of FIG. 1.

The vending machine 1 consists of a frame constructed of beams and posts each provided with a subframe, for instance 2, wherein a holder for frozen products 3 can be loosely placed. The holder 3 rests for example on pins, whereof one 4 is visible. By means of keys on a control panel 5 a particular product can be chosen. Following selection of a product the conveyor 6 moves to the relevant storage holder, for instance 7. The conveyor 6 is guided over a cylinder 8 wherein a piston 9 without a rod is placed. Via a groove 10 a carrier element 11 can engage on the rodless piston 9. The conveyor 6 is provided with a plate 12 which using a ram 13 is horizontally movable between a position (as drawn in FIG. 1) inside the storage holder and a position in front of the storage holder. A frozen product can be carried along during the movement from the position inside the storage holder to the position in front of it.

With the lifting device 14 which consists of a collapsing lever system and which is driven by a ram system 15 the plate can be moved in vertical direction between the position at the height of the delivery point of the storage holder and a position at the height of the access opening to a microwave oven 16 or 17. After the plate has been set down and moved to the access opening of a microwave oven 16 or 17 the frozen product is pushed by the plate 12 into the microwave oven. After heating the plate moves outward and the product is pushed off the plate. For this purpose use is made of a claw 19 which is movable by a piston 18 and grips behind the product and slides the product outward as according to the arrow shown in FIG. 2 into the take-out compartment. Arranged in front of the opening of the microwave oven are take-out compartments 20 and 21. The microwave oven can be closed by a valve, for example 22 (see FIG. 2), which is operated with a lever 23 by a ram 24.

We claim:

1. A vending machine for food goods provided with a plurality of cooled storage holders for packaged food goods, comprising: a selection device for selecting one of said storage holders, first means for removing from said storage holder and vertically transferring to one of a plurality of microwave ovens a packaged product and second means for displacing the packaged product from the microwave oven to a take-out device, characterized in that said first means comprise conveying means for displacing said packaged product vertically from a first position close to said chosen storage holder to a second position close to said microwave oven.

2. Vending machine as claimed in claim 1, characterized in that the plate is horizontally movable between a position inside a storage holder and a position in front of the storage holder.

3. A vending machine for food groups provided with a plurality of cooled storage holders for packaged food groups, comprising:

a selection device for selecting one of said storage holders, first means for removing from said storage holder and vertically transferring to one of a plurality of microwave ovens a packaged product and second means for displacing the packaged product from the microwave oven to a take-out device, characterized in that said first means comprise conveying means for displacing said packaged product vertically from a first position close to said chosen storage holder to a second position close to said microwave oven, wherein a number of storage holders are placed in one line, the microwave ovens are disposed parallel to the storage holders and the conveying means are formed by a carriage movable along a horizontal guide parallel to the row of storage holders and microwave ovens and provided with a plate movable between a top position at the height of the underside of a storage holder and a bottom position at the height of the access opening of a microwave oven.

4. Vending machine as claimed in claim 3, characterized in that the guide is a cylinder and a gear rack situated in the cylinder and the wall of the cylinder has a groove for passage of a carrier element engaging on the gear rack and coupled to the carriage.

5. Vending machine as claimed in claim 3, characterized in that the means for lifting and setting down the plate between said top position and said bottom position are formed by a collapsing lever system driven by a ram.

6. A vending machine for food groups provided with a plurality of cooled storage holders for packaged food groups, comprising:

a selection device for selecting one of said storage holders, first means for removing from said storage holder and vertically transferring to one of a plurality of microwave ovens a packaged product and second means for displacing the packaged product from the microwave oven to a take-out device, characterized in that said first means comprise conveying means for displacing said packaged product vertically from a first position close to said chosen storage holder to a second position close to said microwave oven, wherein the second means consists of a claw member which is driven by a piston and movable in a horizontal direction between a position in the microwave oven and a position close to a take-out compartment.

7. Vending machine as claimed in claim 3, 4, 6 or 5, characterized in that the plate is horizontally movable between a position inside a storage holder and a position in front of the storage holder.

8. Vending machine as claimed in claim 7, characterized in that the plate is driven by a ram.

9. A vending machine for food groups provided with a plurality of cooled storage holders for packaged food groups, comprising:

a selection device for selecting one of said storage holders, first means for removing from said storage holder and vertically transferring to one of a plurality of microwave ovens a packaged product and second means for displacing the packaged product from the microwave oven to a take-out device, characterized in that said first means comprise conveying means for displacing said packaged product vertically from a first position close to said chosen storage holder to a second position close to said microwave oven, wherein the plate is horizontally movable between a position inside a storage holder and a position in front of the storage holder and the plate is driven by a ram.

10. Vending machine as claimed in claim 9, characterized in that the storage holders are placed in a first line and that two microwave ovens are placed in a second line parallel to said first line.

11. Vending machine as claimed in claim 10, characterized in that each storage holder consists of a vertically disposed frame and a roughly cylindrical holder loosely placeable in the frame.

12. Vending machine as claimed in claim 9, characterized in that the storage holders are placed in a first line and that two microwave ovens are placed in a second line parallel to said first line.

13. Vending machine as claimed in claim 10, characterized in that each storage holder consists of a vertically disposed frame and a roughly cylindrical holder loosely placeable in the frame.

14. A vending machine for food groups provided with a plurality of cooled storage holders for packaged food groups, comprising:

a selection device for selecting one of said storage holders, first means for removing from said storage holder and vertically transferring to one of a plurality of microwave ovens a packaged product and second means for displacing the packaged product from the microwave oven to a take-out device, characterized in that said first means comprise conveying means for displacing said packaged product vertically from a first position close to said chosen storage holder to a second position close to said microwave oven, wherein the vending machine includes a pneumatic means for placing the product in the microwave oven such that the product is positioned between microwave transmitters placed oppositely and at different heights, one of the transmitters is located 195 mm from an end wall of the oven and the other 65 mm from this end wall and the said first transmitter lies at a height of 8 mm from the bottom and the other transmitter at a height of 240 mm from the bottom.

* * * * *